US005221067A

United States Patent [19]

Burchell et al.

[11] Patent Number: 5,221,067

[45] Date of Patent: Jun. 22, 1993

[54] WALL PARTITION BRACKET ASSEMBLY

[75] Inventors: David P. Burchell, Valley Park; Herbert C. Hogrebe, St. Louis; Carl X. Meyer, Grantwood Village; James A. Schmid, St. Louis, all of Mo.

[73] Assignee: Dazor Manufacturing Corp., St. Louis, Mo.

[21] Appl. No.: 892,579

[22] Filed: Jun. 3, 1992

[51] Int. Cl.[5] ..... A47K 1/00

[52] U.S. Cl. ..... 248/222.2; 248/224.3; 362/432

[58] Field of Search ..... 248/221.2, 222.2, 222.3, 248/223.4, 224.3, 225.2, 227, 220.2, 290, 294, 284, 200; 362/432

[56] References Cited

U.S. PATENT DOCUMENTS

| | | | |
|---|---|---|---|
| 4,071,216 | 1/1978 | Einhorn | 248/290 |
| 4,386,393 | 5/1983 | Pike | 362/432 X |
| 5,086,958 | 2/1992 | Nagy | 248/223.4 X |

OTHER PUBLICATIONS

Eldon Office Products-Eldonwal System Copyright 1985-Single sheet leaflet.

Luxo Lamp Corp.-Luxo Space Saver Rail Mount System Undated-Page not numbered.

Waldman Lighting-Cad-Lite Panel Bracket Undated-Page 4.

Swingline Partition Task Light Undated (Best available copy) p. 583 Shows lamp mounted between wall panels.

Waldman Lighting Undated (Best available copy) 3 pages, not numbered Shows rail mounted lamp.

*Primary Examiner*—Ramon O. Ramirez

*Attorney, Agent, or Firm*—Cohn, Powell & Hind

[57] ABSTRACT

This bracket assembly (10) is for attachment to wall partitions (12) having slotted members (14). The bracket assembly includes a base (30) adapted to carry a task light L or the like, a connecting bracket (32) having spaced tangs (60 and 62) received by selected vertically spaced slots (22) for connection of the bracket to the vertical member (14) and a fastener (34) for adjustably connecting the base (30) to the bracket (32). A modified construction provides brackets (34) attached to a pair of spaced vertical members (14) to connect modified bases (130) supporting a track assembly (100) between the vertical members (14) the track assembly including a track member (102) and a mounting member (104) movably mounted to the track member and adapted to carry a task light L, or the like.

18 Claims, 2 Drawing Sheets

WALL PARTITION BRACKET ASSEMBLY

BACKGROUND OF THE INVENTION

This invention relates generally to mounting systems for wall partitions and particularly to a height adjustable bracket assembly for task lights and the like.

Wall partitions are commonly used to divide up office space and it provides a considerable saving in desk space if task lights and similar items can be mounted to the partition rather than taking up valuable desk space.

Mounting systems for partition walls are known in the prior art and are generally mounted to the wall partition in one of three ways. One of these is by attaching a permanent bracket to the wall, another is by providing the task light with a clamp by which it can be attached, for example, to the top of the partition and the third is by providing a bracket assembly which is mounted to the slotted channel which forms part of the partition. It is the latter group with which the present invention is concerned and in this group brackets are known which include elongate bases having rear tangs which interfit the slots provided on the partition, for example as manufactured by Waldmann Lighting Co. of Wheeling, Ill. While such brackets do include height adjustment, they are not readily adapted to suit all slotted wall partition channels and are not adjustable to suit the differences found in the depths of standard and deep partions.

Mounting systems are also known which provide for a task light to be mounted on a track extending between wall partitions in order to provide greater adjustment for task lights, and the like. One such system, manufactured by Luxo Lamp Corporation of Port Chester, N.Y., utilizes plate brackets which are attached to slotted channels and include bent portions for carrying the track or rail directly. One disadvantage of this system is that deep or shallow brackets must be used depending on the type of wall partition and there is no depth adjustment.

The present bracket assembly and bracket assembly overcomes these and other disadvantages in a manner not revealed in the known prior art.

SUMMARY OF THE INVENTION

This bracket assembly is intended for use on office wall partitions and is height adjustable and includes a bracket and base connection which ensures a secure connection. The bracket assembly is also depth adjustable to suit standard and deep partition walls. The bracket is secured and the adjustment effectuated by the use of a single fastener.

This bracket assembly for attaching to a wall partition of the type including a vertical member having a plurality of vertically spaced slots comprises a support base connectible to the vertical member of the wall partition including a rear portion operatively engageable with the wall partition, and an apertured front portion; a connecting bracket including a rear end having a pair of spaced tangs receivable within selected spaced slots of the vertical member and a transversely disposed threaded fastener-receiving portion; and a threaded fastener adjustably receivable within the apertured front portion of the base, and the threaded fastener-receiving portion of the bracket, to draw the base rear portion into engagement with the wall partition.

It is an aspect of this invention to provide that the support base includes opposed grooves receiving the bracket in guided relation.

It is another aspect of this invention to provide that the support base includes a pin-receiving portion adapted to receive a pin of a mounted task article.

It is still another aspect of this invention to provide that the bracket includes vertically spaced upper and lower tangs each adapted to be received and held within a selected vertically spaced slot of the vertical member; to provide that the bracket lower tang includes a lower notch portion adapted to receive a vertical member portion adjacent its tang-receiving slot; and to provide that the bracket upper tang includes an upwardly extending portion adapted to engage a vertical member portion adjacent its associated tang-receiving slot.

It is an aspect of this invention to provide that the bracket fastener-receiving portion is formed from alternately spaced ribs pressed out from the bracket.

It is another aspect of this invention to provide that the bracket includes upper and lower edges, and the base is generally hollow and includes opposed sidewalls, and opposed walls connecting said sidewalls, said opposed walls defining grooves receiving the bracket edges in guided relation.

It is still another aspect of this invention to provide that the bracket includes a front edge, the base is generally hollow and includes an apertured front wall receiving the fastener and providing a bearing for the head of the fastener, and the front edge of the bracket is selectively spaced from the front wall of the base whereby tightening the fastener draws the base into engagement with the wall partition.

It is an aspect of this invention to provide a bracket and track assembly for attaching a track between a pair of wall partition vertical members having a plurality of vertically spaced slots, the bracket and track assembly comprising a pair of bracket assemblies, each comprising a support base including a rear bearing portion operatively engageable with an associated wall partition portion and an apertured front portion; a connecting bracket including a rear end having a pair of spaced tangs receivable within selected spaced slots of the vertical member and a transversely disposed threaded fastener receiving portion; and a threaded fastener adjustably receivable within the apertured front portion of the base and the threaded fastener-receiving portion of the bracket to draw the base rear portion into engagement with said associated wall partition portion, and a track assembly, comprising a track member including opposed ends each supported by a bracket assembly, and a mounting member movably mounted to the track member.

Still another aspect of this invention is to provide that each base rear portion is generally U-shaped and the associated front portion is provided by a cap overfitting said rear portion, said cap and rear portion cooperating to define a side opening receiving the track member.

Yet another aspect of this invention is to provide that each base rear portion includes upper and lower legs having opposed slots receiving the associated bracket in guided relation.

It is another aspect of this invention to provide that each cap includes upper and lower legs having end retaining lips adjacent the side opening for retaining the associated rear portion.

Still another aspect of this invention is to provide that the track member includes upper and lower portions, at least one portion being adapted to receive the mounting member in sliding relation.

Yet another aspect of this invention is to provide that the movable member includes a pin-receiving opening adapted to receive the pin of a mounted task article.

It is an aspect of this invention to provide that the track includes upper and lower flanges, and the movable member extends forwardly of the track member and includes a rear portion received in sliding relation between the upper and lower flanges of the track member; and another aspect to provide that the track member has a generally I-beam configuration and includes upper and lower flanges having inwardly turned lips, and the movable member includes a rear plate portion having outwardly extending flanges received in retained relation between said inwardly turned lips.

This invention is relatively inexpensive and easy to manufacture and operates effectively for its intended purpose.

DESCRIPTION OF THE PREFERRED EMBODIMENTS

Figure 1:
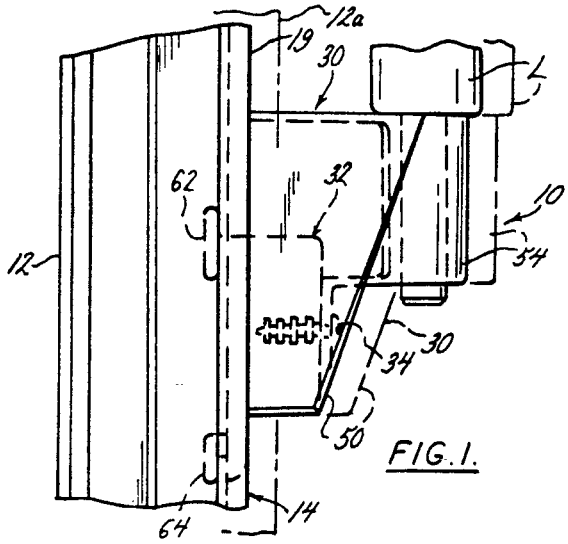
FIG. 1 is a side elevational view of the bracket assembly.
Figure 2:
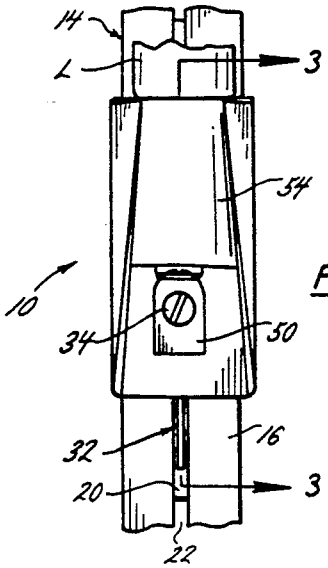
FIG. 2 is a front elevational view of the assembly.

Referring now by reference numerals to the drawings and first to FIGS. 1–6 it will be understood that the bracket assembly 10 is used in conjunction with a wall partition 12, such as an office partition, having a vertical member 14.

Figure 4:
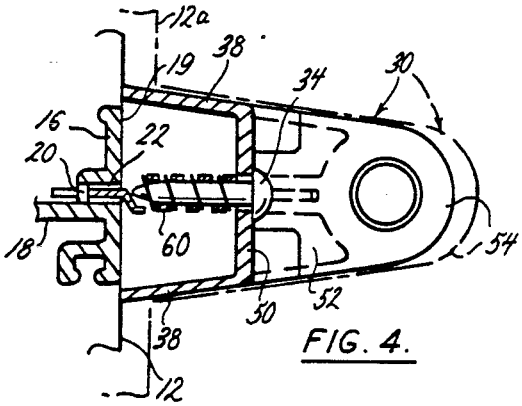
FIG. 4 is a sectional plan view taken on line 4—4 of FIG. 3.

As shown in FIG. 4, the vertical member 14 is formed by two elongate elements 16 and 18 interconnected by a slotted web 20. The slots 22 are spaced at equal intervals along the length of said member 14 and are flanked by elements 16 and 18 which also cooperate to provide a front flange 19.

The bracket assembly 10 includes a support base 30, a bracket 32 and a connecting fastener 34. The support base 30 is generally hollow in the form of a housing and includes opposed sidewalls 38, an upper wall 40, a lower wall 42 and an intermediate wall 44, said lower and intermediate walls including opposed ribs providing grooves 46 and 48 respectively. The support base 30 also includes a stepped front wall having a lower portion 50 and a horizontal portion 52, and said base also includes a cylindrical portion 54 which is adapted to receive the rotatable pin of a task article such as a task light L.

Figure 3:
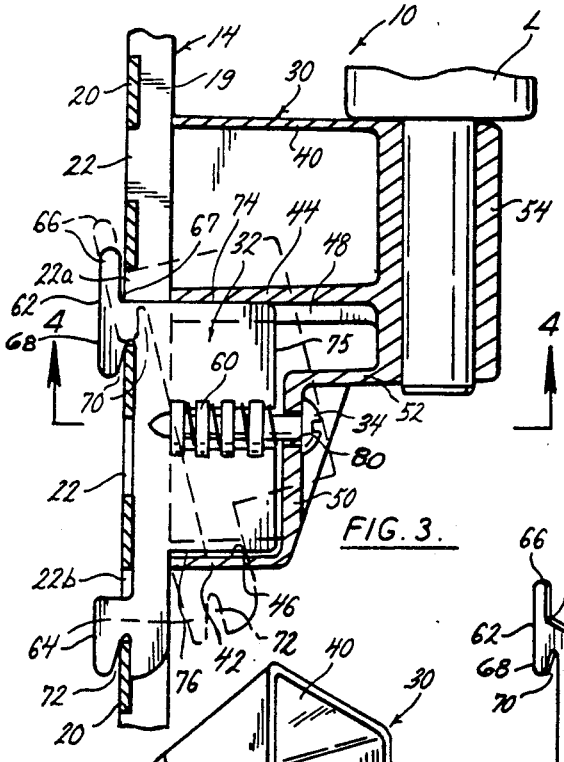
FIG. 3 is a cross sectional view taken on line 3—3 of FIG. 2.

The bracket 32, which cooperates with the fastener 34 to connect the support base 30 to the panel end member 14, is generally flat and includes a body 58 having a fastener-receiving portion 60, preferably formed from alternately pressed out ribs of the bracket plate material, and opposed vertically spaced upper and lower tangs 62 and 64 respectively. The upper tang 62 includes an upwardly extending portion 66, which is engageable with the web portion defining the upper portion of the receiving slot **22*a*, and an lower portion 68, reentrantly formed to provide a notch 70, which receives the web portion defining the lower portion of the receiving slot 22*a*. The lower tang 64 is bifurated to define a notch 72 which receives the web portion defining the lower portion of slot 22*b*. The configuration of the upper and lower tangs is such that, as shown in phantom outline, the upper tang 62 can be inserted into slot 22*a*, and pivoted about the corner 67 so that the lower tang 64 can be rotated into place, at which time the bracket 34 can be lowered into the position shown in FIG. 3 so that the notches 70 and 72 receive the web portions defining the upper portions of slots 22*a* and 22*b* respectively. The upper and lower edges 74 and 76 of the bracket 32 are received by the grooves 48 and 46, respectively, of the base 30, shown in FIG. 6, until the bearing portions provided by the ends of the upper, lower and intermediate walls 40,42 and 44 of said base bear against the front flange 19 of the vertical member 14 which constitutes part of the wall partition 12. The grooves 74 and 76 provide a guide means for correct positioning of the base 30 and hold the base against relative twisting. The fastener 34, for example a self-threading metal screw, can be inserted into the aperture 80 of the base front wall 50 and threadedly received within the bracket fastener-receiving portion 60 until the fastener head 35 bears against the front wall 50 tending to draw the base 30 into engagement with the vertical member 14 and draw the bracket tangs 62 and 64 into engagement with rear portion of the web 20. As shown in FIG. 3, the width of the bracket 32 is such that when the fastener is fully tightened the front edge 75 is spaced from the rear of the base front wall 50. At this point the base 30 is fully secured to the wall partition 12. A particular advantage of this arrangement is that the bracket assembly 10 can be used in conjunction with both standard and deep wall partitions. This is illustrated in FIGS. 1 and 4 which shows that, when a deep wall partition 12*a* is used, the bracket 32 can protrude relatively from the base 30 a greater or lesser amount depending on the amount of engagement by the fastener 36 within the ribs constituting the fastener-receiving portion 60**.

Although a single size of bracket 30 suitable for both standard and deep wall partitions is disclosed, more than one size of bracket can be used, each covering an adjustment range, if necessary.

Figure 5:
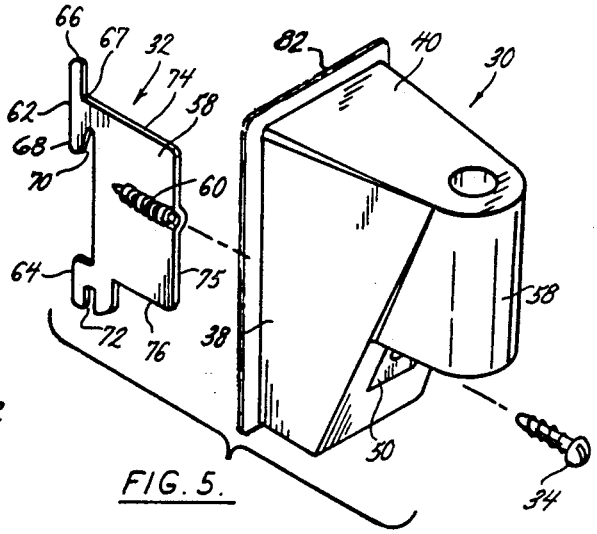
FIG. 5 is an exploded perspective view of the base, bracket and connecting fastener.
Figure 6:
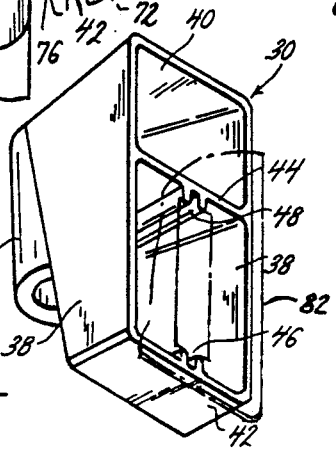
FIG. 6 is a rear perspective view of the base.
Figure 7:
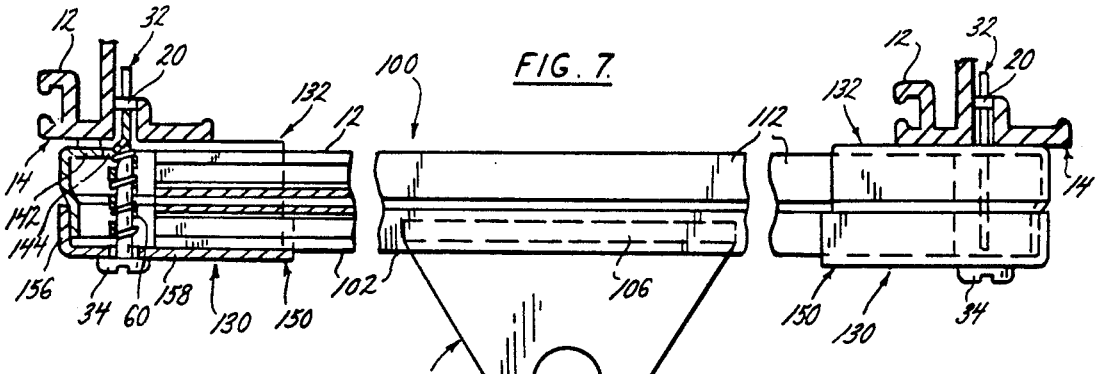
FIG. 7 is a plan view of a modified bracket and track assembly.
Figure 8:
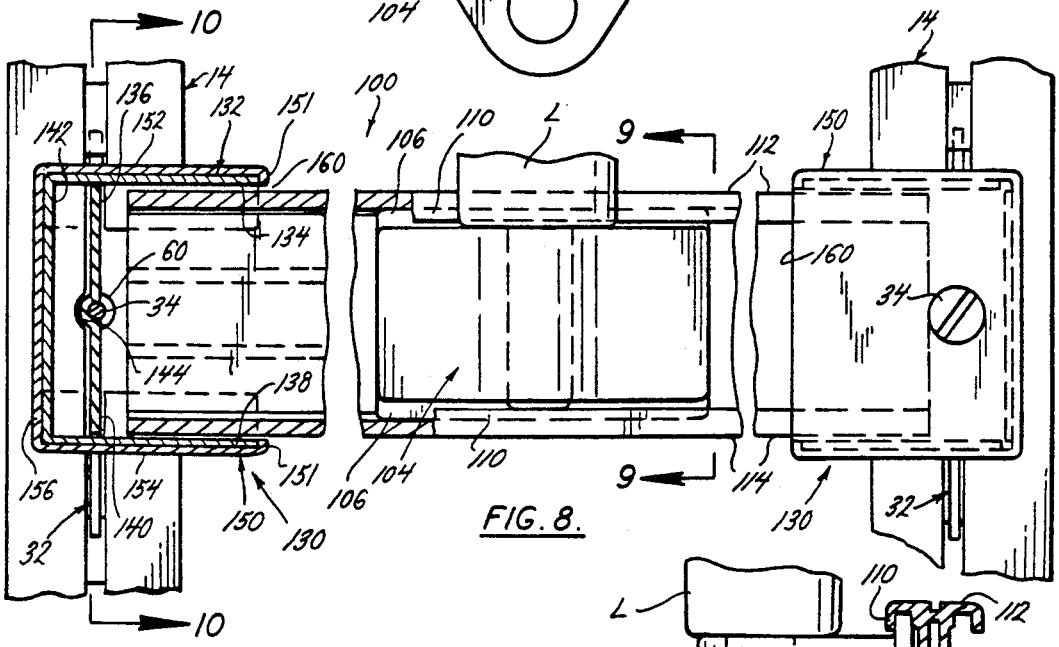
FIG. 8 is a front elevational view thereof, partly in cross section.
Figure 9:
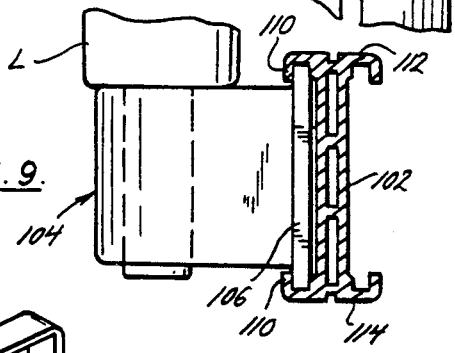
FIG. 9 is a cross sectional view thereof, taken on line 9—9 of FIG. 8.

Also an escutcheon plate 82 can be used where desired as shown in phantom outline in FIG. 5, held in place by the bracket 32 and providing a greater bearing area for the base. The plate 82 is suitably slotted to receive the bracket 32 therethrough.

A modified construction is shown in FIGS. 7–11. In this embodiment a pair bracket assemblies are used in conjunction with spaced slotted vertical channel members 14 to connect an elongate track assembly 100 between two such members. The members 14 are identical with those already described, each being provided with a slotted web 20 having vertical slots 22. The brackets 32 and fasteners 34 are also identical to those used in the previous embodiment. The support bases however, indicated by numeral 130, are different as will now be described.

Figure 10:
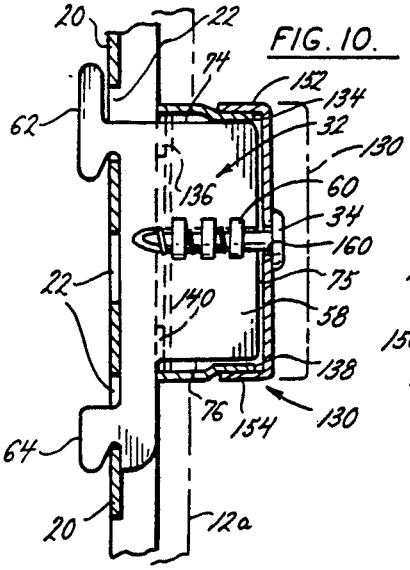
FIG. 10 is a cross sectional view thereof, taken on line 10—10 of FIG. 8.
Figure 11:
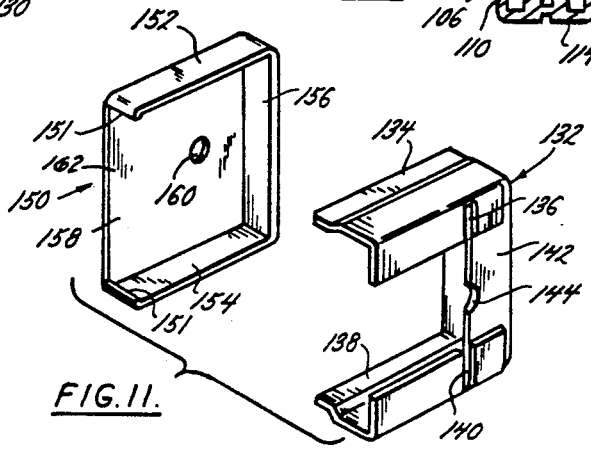
FIG. 11 is an exploded perspective of the base and cap of the modified bracket and track assembly.

Each support base 130 includes a rear bearing portion 132 which is generally U-shaped and includes an upper leg 134, provided with a notch 136, a lower leg 138 provided with an opposed notch 140 and an end leg 142 provided with a notch 144. The base 130 also includes a cap 150 having upper and lower walls 152 and 154, respectively, interconnected by an end wall 156, and a front wall 158 provided with an aperture 160. The legs 134,138 and 142 are crimped to accommodate associated legs 152,154 and 156 respectively of the cap 150. The notches 136 and 140 receive the upper and lower edges 74 and 76 of the bracket 32 and provide a similar guiding function as the grooves 48 and 46 in the previous embodiment and assist in holding the bracket 32 in place relative to the base 130. The notch 144 accommodates the fastener-receiving portion 60 of the bracket. As shown in FIG. 10, the base rear portion 132, with the cap 150 in place, is connected to the panel end member 14 by the fastener 34. The cap 150 is sized to be held snuggly on the rear portion 132 and the upper and lower legs include end lips 151 to assist in holding the cap in place, and to define a track-receiving open end 162 for the box-like base 130.

The track assembly 100, which is carried between the two bases 130, includes an elongate I-beam member 102 and a movable mounting member 104. The mounting member 104 which is generally triangular in configuration, includes a rear plate 106 providing outwardly extending flanges, the flanges being received in retained sliding relation between the inwardly turned front lips 110 of the upper and lower flanges 112 and 114 of the elongate member 102. The mounting member 104 is bored to suit the rotatable pin of an article, such as a task light L, and provides a movable carriage for said light. The track length can be varied to suit the vertical member spacing, typically from 2–4 feet.

The installation of the track assembly 100 between the spaced members 14 can be accomplished by first installing the brackets 32 on the vertical end members 14 substantially as described with respect to the first embodiment. Each base rear portion 132 is fitted with its cap 150, and the bases 130 can then be loosely fitted to the ends of the track 102, with the mounting member 104 having first been slid into place from the end of the track. The bases can then be connected to the brackets 32 by fasteners 34. As shown in FIG. 10, and similar to the previous embodiment, the width of the bracket 32 is such that when the fastener is fully tightened the bracket front edge 75 is spaced from the cap front wall 158, the base bearing portion being provided by the U-shaped legs. At this point the bases 130 and the track member 102 are fully secured to the vertical members 14. It will be understood that the relationship between the base 130, bracket 132 and fastener 34 are such that, as with the assembly previously described, the protrusion of the bracket 34 rearwardly of the base 130 can be adjusted by the engagement of the fastener 34 within the fastener receiving portion 60 to suit both standard and deep wall partitions, 12 and 12*a*.

Although the improved assemblies have been described by making particular reference to a preferred bracket assembly and track assembly, the details of description are not to be understood as restrictive, numerous variants being possible within the principles disclosed and within the fair scope of the claims hereunto appended.

We claim as our invention:

1. A bracket assembly for attaching a wall partition of the type including a vertical member having a plurality of vertically spaced slots, the bracket assembly comprising:

(a) a support base connectible to the vertical member of the wall partition including a rear portion operatively engageable with the wall partition, and an apertured front portion, (b) a connecting bracket including a rear end having a pair of spaced tangs receivable within selected spaced slots of the vertical member and a transversely disposed threaded fastener-receiving portion, and (c) a threaded fastener adjustably receivable within the apertured front portion of the base, and the threaded fastener-receiving portion of the bracket, to draw the base rear portion into engagement with the wall partition.

2. A bracket assembly as defined in claim 1, in which:

(d) the support base includes opposed grooves receiving the bracket in guided relation.

3. A bracket assembly as defined in claim 1, in which:

(d) the support base includes a pin-receiving portion adapted to receive a pin of a mounted task article.

4. A bracket assembly as defined in claim 1, in which:

(d) the bracket includes vertically spaced upper and lower tangs each adapted to be received and held within a selected vertically spaced slot of the vertical member.

5. A bracket assembly as defined in claim 4, in which:

(e) the bracket lower tang includes a lower notch portion adapted to receive a vertical member portion adjacent its tang-receiving slot.

6. A bracket assembly as defined in claim 5, in which:

(f) the bracket upper tang includes an upwardly extending portion adapted to engage a vertical member portion adjacent its associated tang-receiving slot.

7. A bracket assembly as defined in claim 4, in which:

(e) the bracket upper and lower tangs each includes a lower notch portion adapted to receive a vertical member portion adjacent its associated tang-receiving slot.

8. A bracket assembly as defined in claim 1, in which:

(d) the bracket fastener-receiving portion is formed from alternately spaced ribs pressed out from the bracket.

9. A bracket assembly as defined in claim 1, in which:

(d) the bracket includes upper and lower edges, and (e) the base is generally hollow and includes opposed sidewalls, and opposed walls connecting said sidewalls, said opposed walls defining grooves receiving the bracket edges in guided relation.

10. A bracket assembly as defined in claim 1, in which:

(d) the bracket includes a front edge, (e) the base is generally hollow and includes an apertured front wall receiving the fastener and providing a bearing for the head of the fastener, and (f) the front edge of the bracket is selectively spaced from the front wall of the base whereby tightening the fastener draws the base into engagement with the wall partition.

11. A bracket and track assembly for attaching a track between a pair of wall partition vertical members having a plurality of vertically spaced slots, the bracket and track assembly comprising:

(a) a pair of bracket assemblies, each comprising:

(1) a support base including a rear bearing portion operatively engageable with an associated wall partition portion and an apertured front portion, (2) a connecting bracket including a rear end having a pair of spaced tangs receivable within selected spaced slots of the vertical member and a transversely disposed threaded fastener receiving portion, and (3) a threaded fastener adjustably receivable within the apertured front portion of the base and the threaded fastener-receiving portion of the bracket to draw the base rear portion into engagement with said associated wall partition portion, (b) a track assembly, comprising:

(1) a track member including opposed ends each supported by a bracket assembly, and (2) a mounting member movably mounted to the track member.

12. A bracket and track assembly as defined in claim 11, in which:

(c) each base rear portion is generally U-shaped and the associated front portion is provided by a cap overfitting said rear portion, said cap and rear portion cooperating to define a side opening receiving the track member.

13. A bracket and track assembly as defined in claim 12, in which:

(d) each base rear portion includes upper and lower legs having opposed slots receiving the associated bracket in guided relation.

14. A bracket and track assembly as defined in claim 13, in which:

(c) each cap includes upper and lower legs having end retaining lips adjacent the side opening for retaining the associated rear portion.

15. A bracket and track assembly as defined in claim 11, in which:

(c) the track member includes upper and lower portions, at least one portion being adapted to receive the mounting member in sliding relation.

16. A bracket and track assembly as defined in claim 11, in which:

(c) the movable member includes a pin-receiving opening adapted to receive the pin of a mounted task article.

17. A bracket and track assembly as defined in claim 15, in which:

(c) the track includes upper and lower flanges, and (d) the movable member extends forwardly of the track member and includes a rear portion received in sliding relation between the upper and lower flanges of the track member.

18. A bracket and track assembly as defined in claim 17, in which:

(e) the track member has a generally I-beam configuration and includes upper and lower flanges having inwardly turned lips, and (f) the movable member includes a rear plate portion having outwardly extending flanges received in retained relation between said inwardly turned lips.

* * * * *